US005329688A

United States Patent [19]

Arvedi et al.

[11] Patent Number: 5,329,688

[45] Date of Patent: Jul. 19, 1994

[54] PROCESS AND PLANT FOR OBTAINING STEEL STRIP COILS HAVING COLD-ROLLED CHARACTERISTICS AND DIRECTLY OBTAINED IN A HOT-ROLLING LINE

[75] Inventors: Giovanni Arvedi, Via Mercatello, 26; Giovanni Gosio, both of Cremona, Italy

[73] Assignees: Giovanni Arvedi, Cremona, Italy; Hoogovens Groep BV, Ijmuiden, Netherlands

[21] Appl. No.: 971,846

[22] PCT Filed: Jul. 5, 1991

[86] PCT No.: PCT/IT91/00057

§ 371 Date: Jan. 8, 1993

§ 102(e) Date: Jan. 8, 1993

[87] PCT Pub. No.: WO92/00815

PCT Pub. Date: Jan. 23, 1992

[30] Foreign Application Priority Data

Jul. 9, 1990 [IT] Italy ..... 20884 A/90

[51] Int. Cl.[5] ..... B21B 1/46; B22D 11/12

[52] U.S. Cl. ..... 29/527.7; 29/81.03; 29/DIG. 5; 29/DIG. 32; 72/201; 72/366.2; 164/442

[58] Field of Search ..... 29/81.03, 81.04, 527.5, 29/527.6, 527.7, DIG. 5, DIG. 10, DIG. 32, DIG. 34; 72/39, 40, 200, 201, 202, 237, 364, 365.2, 366.2; 148/538, 541, 545, 547, 548; 164/270.1, 417–420, 441, 442, 443, 448

[56] References Cited

U.S. PATENT DOCUMENTS

| | | | |
|---|---|---|---|
| 2,226,500 | 12/1940 | Matthews | 29/81.03 X |
| 2,359,095 | 9/1944 | Elder et al. | 29/81.03 X |
| 2,702,766 | 2/1955 | Weiser | 29/81.03 X |
| 3,154,442 | 10/1964 | Nye et al. | 29/81.04 X |
| 4,793,168 | 12/1988 | Kimura | 29/527.7 X |
| 4,872,245 | 10/1989 | Kawasaki et al. | 72/40 X |

FOREIGN PATENT DOCUMENTS

| | | | |
|---|---|---|---|
| 0226446 | 6/1987 | European Pat. Off. . | |
| 0306076 | 3/1989 | European Pat. Off. . | |
| 0370575 | 5/1990 | European Pat. Off. . | |
| 1903554 | 8/1969 | Fed. Rep. of Germany . | |
| 27800 | 11/1955 | Finland | 29/81.03 |
| 56144805 | 2/1982 | Japan . | |
| 8911363 | 11/1989 | PCT Int'l Appl. . | |

OTHER PUBLICATIONS

T. Okamoto et al.: "Manufacturing of deep ∝ drawing sheet by warm rolling", Sheet Metal Industries, vol. 50, No. 5, May 1973, (Redhill, GB), pp. 297–302.

Steel Times International: "Thin end of wedge for mini-mill in Italy", Incorporating Iron & Steel International, vol. 14, No. 5, Sep. 1990, (Redhill, Surrey, GB), pp. 38–39.

*Primary Examiner*—Peter D. Vo

*Attorney, Agent, or Firm*—Browdy and Neimark

[57] ABSTRACT

A process for obtaining steel strip coils with characteristics of a cold-rolled product, directly in a hot-rolling line, comprises subsequently to steps of casting and thickness reduction at a temperature of more than 1100° C. upon solidification, induction heating of the product and a further step of hot rolling, above point $Ar_3$, a step of cooling and temperature control in a range of between 600° and 250° C., thus lower than said point $Ar_3$, as well as one or more passes of cold-rolling in series, with final coiling of the obtained product. Also a preferred plant is described for putting into practice such a process.

19 Claims, 1 Drawing Sheet

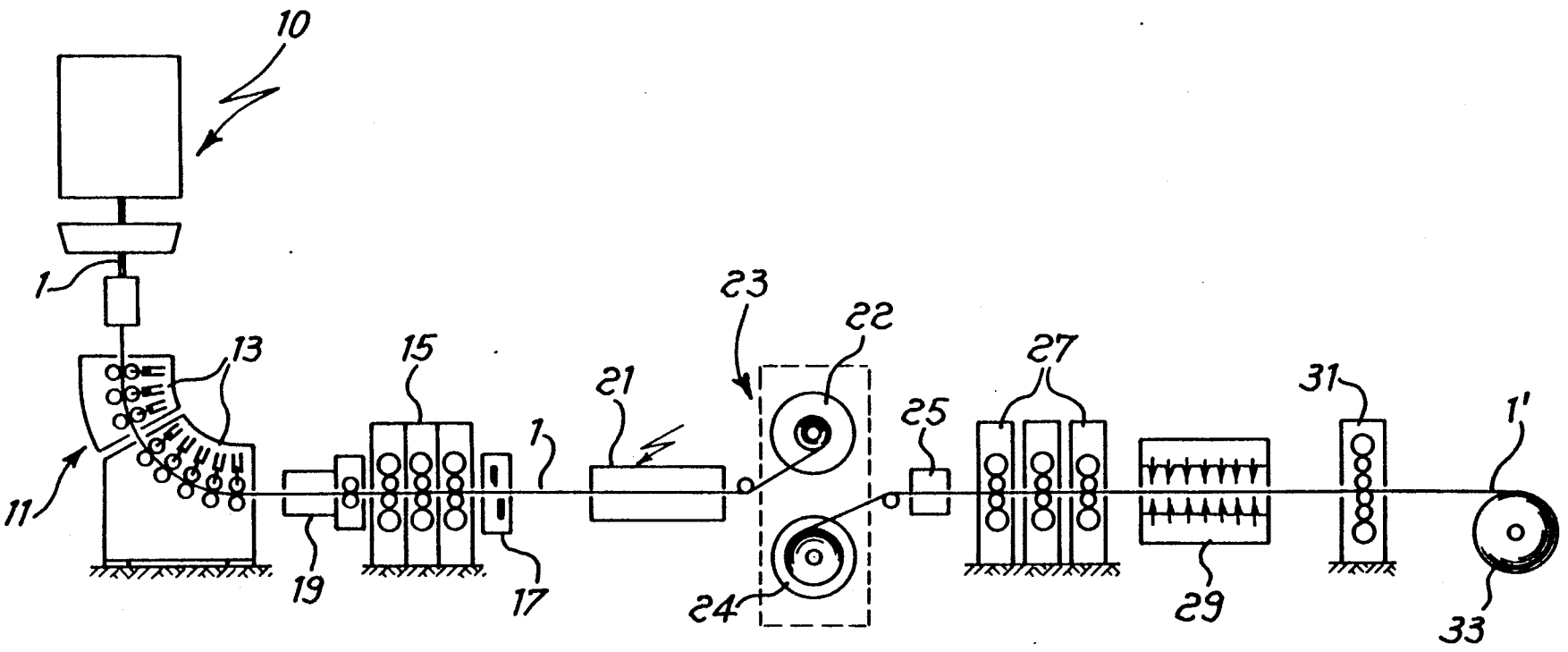
10
1
11
13
19
15
1
17
21
23
22
24
25
27
29
31
1'
33

PROCESS AND PLANT FOR OBTAINING STEEL STRIP COILS HAVING COLD-ROLLED CHARACTERISTICS AND DIRECTLY OBTAINED IN A HOT-ROLLING LINE

The present invention relates to a process and relevant plant for producing coils of steel strips, having characteristics of a cold-rolled product and directly obtained in a hot-rolling line from a continuous casting with arc-shaped path and horizontal outlet.

It is known that for obtaining hot-rolled steel strip coils, the following operations are provided, successively:

- producing by casting a steel slab having a thickness of between 160 and 250 mm, and possibly storing the same;
- heating such a slab, if coming from the store, or in any case bringing it again to a rolling temperature of at least 1050° C.;
- hot-rolling the slab for a first cogging and thereafter for obtained hot-rolled strips having a minimum thickness of 2 mm;
- taking again the hot-rolled strip and subjecting the same to annealing for a reconstruction of the grain which has been deformed and become dishomogeneous during the preceding operations, in particular hot-rolling step;
- subjecting the product to pickling in order to eliminate from its surface the oxides previously formed, especially during annealing; and
- causing the actual cold-rolling step to be performed, which comprises mounting the coil onto an unwinding reel to bring again the strip onto a plane, causing the strip to pass through at least one cold-rolling stand until obtaining thicknesses of less than 1 mm, down to 0.5–0.2 mm and finally winding the strip on a reel to obtain the final coil.

It will be noted that the number of passes in the stands for cold-rolling depends on the desired final thickness and the reduction percentage which is to be obtained, in other words the ratio between thickness of the hot-rolled strip and thickness of the final product. For high values of such a percentage reduction it is not enough to increase the number of said passes, but it will be necessary to subject the strip to another annealing operation and the consequent pickling, otherwise the material hardens and the final product results to be of low quality.

Although it is possible to obtain by hot-rolling strips having a thickness of less than 2 mm, hot-rolling is usually avoided to reach these values, as this type of processing is considered anti-economical, above all due to the reduced productivity that would be obtained in this case with a conventional rolling mill. The costs relating to the reduction of strip thickness are however extremely high in any case. Assuming 100 the cost of hot-rolling, starting from liquid steel, the cost of cold-rolling step alone is of at least 80.

Attempts have been described as to making plants for obtaining thin strips by means of more compact operating cycles with respect to the above-mentioned conventional cycle, in order to reduce complexity and duration of the latter. For example EP-A-226446 describes a number of hot-rolling examples, all in line and at a very high speed (not less than 1500 mm/min) but the final product not only has a thickness of 2–6 mm, falling thereby in the range of hot-rolling, but also certainly does not show the structural features of a cold-rolled product. The main purpose of this published application is in fact restricted to a high productivity while obtaining at the same time a product of good processability, but not of high quality.

In EP-370 575 there is described a method for the manufacture of a steel strip having a final thickness of between 0.5 and 1.5 mm, comprising the steps of hot-rolling a steel slab of less than 100 mm thickness, at a temperature of between 300° C. and a temperature at which at least 75% of the material is converted into ferrite, with a thickness reduction of over 30% in at least one reduction stage, and an exit speed after hot-rolling of less than 1000 m/min, with final coiling of the strip after recrystallization. This was an attempt to avoid the two successive cycles of hot- and cold-rolling, with intermediate stages of annealing and pickling, but also this attempt has been unsuccessful, and it could not find success indeed, apart from the proposed solution, as in any case the inner structure of the material, when subjected to cold-rolling, is unsuitable to undergo this treatment for obtaining a final product of acceptable quality. This occurs owing to the fact that the inner structure, if not recrystallized before cold-rolling, results to be dishomogenous under a dimensional aspect and with insufficiently fine grains, in comparison with the grain size which would be required by the conventional cold-rolling technology according to the above-described cycle.

It is known on the other hand that an eccessive reduction of thickness with successive rolling stands on the same hot-rolling line gives rise to such a temperature decrease to go below the recrystallization point $Ar_3$, at which the steel is no longer austenitic, whereby a subsequent annealing above $Ar_3$ restores the pre-existing structural situation without the benefits of grain reduction.

An attempt in improving the results obtained is disclosed in EP-A-0 306 076 according to which a first rolling step of the product in the austenitic region is followed by a subsequent rolling step in the ferritic region, with the two steps being separated by means of an intermediate cooling step. However, in order to produce high quality steel, recrystallization annealing and possibly pickling steps are required.

Instead it has been surprisingly found that if a preliminary reduction of the thickness is carried out in a liquid core situation of the casting product immediately under the mould, followed by a further reduction of thickness at temperatures higher than 1100° C., the product entering the second rolling step shows an inner structure with fine grains, so uniformly distributed to have the characteristics of a material suitable to be cold-rolled. Therefore it has been thought that rolling up to thickness of less than 1 mm can be obtained with no need of annealing and pickling, as it can be in practice performed in line with the hot-rolling carried out upstream.

In this way a technical prejudice can be overcome, which is extremely common and deep-rooted both among those skilled in hot-rolling, and those, normally distinct therefrom, who are skilled in cold-rolling, since the material obtained in the hot-rolling line results to be suitable to cold-rolling, even if its temperature is caused to be lower than recrystallization point $Ar_3$.

It was found to be important to reach such results, that during the first stage of hot-rolling in the austenitic region the temperature is kept as homogeneous as possible at about 1100° C. by induction re-heating, as disclosed in WO 89/11363.

Therefore it is an object of the present invention to provide a process and relevant plant for obtaining a cold-rolled product, of extremely thin thickness, directly starting from the hot-rolled product, being coupled thereto as to the speed and with no need of further treatment (such as annealing and pickling) on the material, thereby without any discontinuity in the manufacturing line.

This is obtained by means of a process according to the features of present claim 1.

It should be appreciated that the expected temperature at the outlet from the controlled cooling device is always less than that of recrystallization point $Ar_3$, which varies according to the carbon content in the steel, with a minimum of 690° C. for 0.6% of carbon, up to a maximum of 900° C. for lower or higher carbon contents. Therefore it is certain that the subsequent processing is actually a cold-rolling step, which is carried out on a material the inner structure of which has all the required characteristics in order that the cold-rolling operation is accomplished in the best way and the final product is provided, from a metallurgical point of view, with all the properties which are required to a cold-rolled product.

These and further objects, advantages and features of the process according to the present invention, as well as of the relevant plant, will be clear to those skilled in the art from the following detailed description of a preferred embodiment, given by way of a non-limiting example with reference to the annexed drawing showing a diagrammatic view of a plant according to the invention, useful to describe also the process of the invention.

From a continuous casting mould 10, the steel flat product 1, driven and guided by a known-type roller path being arc-shaped, from an initially vertical direction, passes through the arc-shaped path formed by the rollers 11, to a horizontal direction. The thickness of the casting product 1 is firstly reduced in a condition of liquid core, for example in two distinct sections of rollers 13 and thereafter, upon solidification, but still at a temperature of about 1100° C., in a first stage of rolling 15 at the end of the bent path 11 and at the beginning of the horizontal path. Subsequently, in an induction oven 21 the flat product 1 is re-heated to bring it again to hot-rolling temperature, and then rolled in one or more rolling stands 27, between which there may be possibly provided additional induction ovens (not shown in the drawing) for maintaining the rolling temperature of at least 865° C. at the outlet from the stand.

According to an embodiment of this first portion of the plant, substantially already known from WO 89/11363, immediately after the first rolling stage 15 there may be provided a shear 17 and before said stage 15 a discaling device 19 for eliminating scale from the surface of the product to be treated. Furthermore, between the induction oven 21 and the hot-rolling stands 27 there may be provided a winding and unwinding device 23 comprising a reel 22 for coiling the strip from oven 21, being coupled to a reel 24 for uncoiling the strip itself to be fed to stands 27, possibly after an additional discaling step in a suitable device 25 provided at the inlet of the first rolling stand.

According to the present invention, the hot-rolled strip 1, at the outlet of the last rolling stand 27 at a temperature certainly higher than the recrystallization point $Ar_3$, is caused to enter, still in the same production line, a cooling and temperature controlling apparatus 29, at the exit of which the strip has a temperature, controllable at each time, comprised in a range of between 250° and 600° C. It substantially consists of a waterbased cooling device, for example of the so-called "laminar rain" type, being provided with a temperature detector with a feed-back controlling the valves for feeding water into the device. The value of temperature to be fixed for strip 1 at the inlet of the subsequent cold-rolling stage, with deviations of not more than 20° C., will depend on the type of steel (carbon content, etc.), the feeding speed of the strip and its thickness, but in any case it will be less than the temperature at the recrystallization point $Ar_3$, which varies between 900° C. and a minimum of 690° C. for a carbon content of 0.6%. As the maximum temperature provided at the outlet of apparatus 29, thereby at the inlet of subsequent cold-rolling stage 31, is of 600° C., the strip is surely under the point $Ar_3$, and thus at the best conditions to undergo the cold-rolling step, due to the fine grain structure of the material from the upstream treatment, absolutely suitable to be subjected to cold-rolling.

Such a rolling occurs in at least one stand, for example of "six high" type, i.e. with six rolls mounted in vertical. The passes of cold-rolling may however be more than one, but all in series when providing a multiplicity of stands side by side, contrary to the method of providing for a multiplicity of subsequent passes in the same stands, as according to the conventional technology of cold-rolling.

Finally the cold-rolled strip, with a thickness of less than 1 mm, ready for use as it shows the tipical microcrystalline features of a cold-rolled product, such as a homogeneous distribution of grains, is wound on a final coiler 33. The lower limit of the thickness that can be obtained in this way will be only dictated by the nip of the cold-rolling stands 31, as well as their precision, not certainly by problems of material hardening or anyhow deriving from its metallurgical structure.

We claim:

1. A process for obtaining steel strip coil directly from a hot-rolling line, said steel strip coil having characteristics of a cold-rolled product, comprising:

mould casting a flat product having a thickness of less than 100 mm;

reducing the thickness of said flat product immediately beyond the mould while maintaining a liquid core of said flat product;

after solidification of the core of said flat product, further reducing the thickness of said flat product by rolling at a temperature greater than 1100° C. to provide a flat product of 10–30 mm thickness;

induction re-heating said flat product to provide a substantially homogeneous temperature throughout said flat product of about 1100° C.;

subjecting said flat product to a further stage of hot-rolling in the austenitic region at a temperature above a temperature value corresponding to transformation point $Ar_3$;

reducing the temperature of the flat product to a temperature lower than a temperature corresponding to said transformation point $Ar_3$; and subjecting said flat product to at least one cold-rolling to obtain said steel strip having characteristics of cold-rolled product.

2. A process according to claim 1, wherein said hot-rolling stage at a temperature below the transformation point $Ar_3$ is carried out in the range of 250° C.–600° C.

3. A process according to claim 1, further comprising at least one of the following steps:

(i) coiling and subsequent uncoiling of the strip immediately after the induction re-heating, upon cutting the strip immediately after the first rolling stage;

(ii) at least one discaling step; and (iii) additional heating between two further stages of hot-rolling.

4. A plant for obtaining steel strip coils having characteristics of cold-rolled product, directly obtained in a hot-rolling line, comprising:

means (10) for continuous casting of flat product (1) with a subsequent arc-shaped guide roller path (11);

first reduction means (13, 15) for reducing thickness of the flat product in said arc-shaped path when it is in a condition of liquid core or immediately thereafter upon solidification of said flat product (1);

heating means (21) for induction heating and homogenization of temperature throughout of the flat product (1) downstream of said first reduction means;

at least one additional rolling stand (27) downstream from said heating means;

cooling means (29) for cooling and controlling the temperature of the flat product (1) until under transformation point $Ar_3$ immediately downstream of said additional hot-rolling stand (27);

at least one cold-rolling stand (31) downstream of said cooling means; and coiler means (33) for winding the strip in a coil (1') downstream of said cold-rolling stand.

5. A plant according to claim 4, further comprising at least an additional induction oven intermediate between two subsequent ones of said additional rolling stands (27).

6. A plant according to claim 4, characterized in that the range of variation of the temperature at the exit of said device (29) is between 250° and 600° C., with a deviation of more or less 10° from the prefixed value at the inside of said range according to the quality of steel, the feeding speed and the product (1) thickness.

7. A plant according to claim 6, further comprising a device (23) for winding and subsequently unwinding the strip immediately downstream of the induction oven (21), upstream of the latter being provided a shear cutting device (17).

8. A plant according to claim 7, further comprising at least a discaling device (19, 25), respectively upstream of the first rolling stage (15) and downstream of said induction oven.

9. A plant according to claim 4, wherein said cooling apparatus (29) is a water cooling device with water feeding valves and having a temperature detector with feed-back for automatic controlling the cooling water feeding valves.

10. A plant according to claim 9, further comprising a device (23) for winding and subsequently unwinding the strip immediately downstream of the induction oven (21), upstream of the latter being provided a shear cutting device (17).

11. A plant according to claim 9, further comprising at least a discaling device (19, 25), respectively upstream of the first rolling stage (15) and downstream of said induction oven.

12. A plant according to claim 9, further comprising at least an additional induction oven intermediate between two subsequent rolling stands (27).

13. A plant according to claim 9, wherein said cooling means (29) comprises means for cooling the flat product when leaving said cooling means to within the range of 250° to 600° C., according to the quality of steel, the feeding speed and the flat product (1) thickness.

14. A plant according to claim 13, further comprising at least a discaling device (19, 25), respectively upstream of the first rolling stage (15) and downstream of said induction oven.

15. A plant according to claim 13, further comprising at least an additional induction oven intermediate between two subsequent rolling stands (27).

16. A plant according to claim 4, further comprising means (23) for winding and subsequently unwinding the flat product immediately downstream of the heating means (21), upstream of the heating means there being provided a shear cutting device (17).

17. A plant according to claim 16, further comprising at least an additional induction oven intermediate between two subsequent rolling stands (27).

18. A plant according to claim 16, further comprising discaling means upstream of the first reduction means (15) or downstream of said heating means 21, or a discaling means (19, 25) both upstream of said first reduction means and downstream of said heating means.

19. A plant according to claim 18, wherein the discaling means (25) downstream of the heating means (21) is positioned immediately after said winding and unwinding means (23).

* * * * *